United States Patent [19]

Soepenberg

[11] 4,255,239

[45] Mar. 10, 1981

[54] METHOD FOR MAKING TINNED STEEL PLATE FREE FROM SURFACE GRAPHITE

[75] Inventor: Everhardus N. Soepenberg, Castricum, Netherlands

[73] Assignee: Hoogovens IJmuiden BV, IJmuiden, Netherlands

[21] Appl. No.: 51,398

[22] Filed: Jun. 25, 1979

Related U.S. Application Data

[63] Continuation of Ser. No. 932,401, Aug. 9, 1978, abandoned, which is a continuation of Ser. No. 834,066, Sep. 16, 1977, abandoned, which is a continuation of Ser. No. 740,057, Nov. 8, 1977, abandoned, which is a continuation of Ser. No. 583,170, Jun. 3, 1975, abandoned.

[30] Foreign Application Priority Data

Jun. 5, 1974 [NL] Netherlands ..... 7407528

[51] Int. Cl.[3] ..... C25D 5/26; C25D 5/36

[52] U.S. Cl. ..... 204/28; 204/34

[58] Field of Search ..... 204/34, 28; 93/2, 401

[56] References Cited

U.S. PATENT DOCUMENTS

| | | | |
|---|---|---|---|
| 2,431,947 | 12/1947 | Martz | 204/34 |
| 2,915,444 | 12/1959 | Meyer | 204/34 X |
| 3,075,897 | 1/1963 | Higgs | 204/34 X |
| 3,259,557 | 7/1966 | Smith et al. | 204/28 |
| 3,308,042 | 3/1967 | Lozano et al. | 204/28 |
| 3,531,380 | 9/1970 | Austin et al. | 204/34 |
| 3,594,288 | 7/1971 | Reinert | 204/34 |
| 3,632,487 | 1/1972 | Brown et al. | 204/34 |
| 3,756,926 | 9/1973 | Brown et al. | 204/34 X |

FOREIGN PATENT DOCUMENTS 7402743 10/1974 Netherlands .

*Primary Examiner*—G. L. Kaplan

*Attorney, Agent, or Firm*—Stevens, Davis, Miller & Mosher

[57] ABSTRACT

A method of producing steel strip having a metal coating layer including the steps of (a) cold rolling a hot-rolled steel strip, (b) cleaning the cold rolled strip by means of an electrolysis bath, (c) rinsing the cleaned strip, (d) tightly coiling or packing the rinsed strip, annealing it and skin-passing it, and (e) electrolytically applying the said metal coating layer. In the said rinsing step (c) or subsequently thereto, the strip is passed through a bath which contains, in a suitable amount, a conditioning substance selected from the group consisting of urea, thiosemicarbazide, ammonium thiosulphate, borax and a mixture of such substances which is preferentially adsorbed on the surface of the strip and which in the annealing hinders or prevents the formation of surface graphite by the carbon within the steel.

9 Claims, No Drawings

METHOD FOR MAKING TINNED STEEL PLATE FREE FROM SURFACE GRAPHITE

This is a continuation of application Ser. No. 932,401 filed Aug. 9, 1978 which in turn is a continuation of Application Ser. No. 834,066 filed Sep. 16, 1977 which in turn is a continuation of Application Ser. No. 740,057 filed Nov. 8, 1977, which in turn is a continuation of Applicatin Ser. No. 583,170 filed June 3, 1975 all abandoned.

The invention relates to a method of producing steel strip having a metal coating layer applied by electrolysis. The invention also relates to steel strip coated in this way. The invention will be described principally in connection with the production of tinned sheet material, although it is not restriced thereto.

In tinning cold-rolled steel strip a common fault in quality is the presence of adhering surface graphite. For a long period it was assumed that this surface graphite derived from organic dirt on the cold-rolled steel, which dirt during annealing carbonized and graphitised. In fact for a long period most of the tinned strips which were inhibited with graphite could be traced to this cause. In U.S. Pat. No. 3,632,487 there has been described a method in which an attempt is made to counteract this surface fault by adding to the last washing bath a substance which with the organic dirt forms a gaseous compound in the annealing heat, which compound thereupon can escape.

It has appeared to the applicant, however, that the quality fault of the surface graphite also appears when starting from a surface which is absolutely clean of any organic remainders. Actually recently it was found that this latter phenomenon may occur more frequently the purer the steel and the fewer polluting alloying elements it contains.

Further investigation by the applicant has shown that with usual steel compositions after annealing of a tightly coiled and cleaned steel strip there may be present on the surface, apart from some iron oxides and iron carbides, graphite which has grown preferentially on distinct crystal boundaries. Further investigation has shown that this graphite originates from out of the steel itself. Also, this surface graphitisation only occurs on surfaces which were not freely flushed during annealing. Further it was confirmed that loosely adhereing solid particles on the surface stimulate the graphitisation process.

It was also found that the conditioning of the surface before annealing may be decisive for the formation of graphite. Further investigation raises the supposition that the formation of surface graphite belongs to the type of gas-metal reactions which have been described as catalytic corrosion. By a complex process of solid-gas reactions which are determined by diffusion at the surface, successively comprising among other things the formation of unstable carbon monoxide from carbon in the steel under the prevailing conditions, an intermediate formation of surface carbides, and finally the decomposition of these carbides into graphite, the graphitisation process in discussion may be initiated. The diluted carbon which as a result is taken from the steel is then supplemented by decomposition of carbides which are present in the steel.

The observed formation of surface graphite is therefore independent of organic pollutants possibly remaining on the surface. The method described in U.S. Pat. No. 3,632,487 which among other things results in the formation of gaseous carbon monoxide, cannot therefore counteract the above described graphitisation process.

The invention aims at cleaning the steel strip of organic pollutants before annealing, and thereupon preparing the surface of the steel strip by a substance admixed to the last rinsing bath or to a subsequent bath through which the strip is passed, in a manner such that the chain of reactions which leads from cementite within the steel to surface graphite is interrupted. According to the present invention there is provided a method of producing steel strip having a metal coating layer including the steps of (a) cold rolling a hot-rolled steel strip, (b) cleaning the cold rolled strip by means of an electrolyse bath, (c) rinsing the cleansed strip (d) tightly coiling or packing the rinsed strip, annealing it and skin-passing it, and (e) electrolytically applying the said metal coating layer, characterized in that in the said rinsing step (c) or subsequently thereto, the strip is passed through a bath which contains, in a suitable amount, a conditioning substance or mixture of such substances which is preferentially adsorbed on the surface of the strip and which in the annealing hinders or prevents the formation of surface graphite by the carbon within the steel. It is of the essence of the present invention that treatment in aneloctrolyses bath to remove surface dirt is combined with the subsequent treatment by the conditioning substance or substances to inhibit the formation of surface graphite by the carbon within the steel. In the process of U.S. Pat. No. 3,632,487, there is no treatment in an electrolysis bath and no mention of the problem of graphite formation by the carbon within the steel.

Advantageously, as in known processes, the strip is pickled and rinsed prior to the cold-rolling step (a). Preferably also, the said cleaning step (b) comprises passing the strip through a dip bath, brushing it, passing it through the said electrolyses both and brushing it again.

The said conditioning substance or substances may be present in the rinsing bath of step (c), or may be present in a separate bath through which the strip passes subsequently to the rinsing of step (c).

A preferred concentration range for the conditioning substance or substances is 10 to 5.000 p.p.m. in the bath containing them.

Desirably the electrolysis bath of step (b) contains usual saponifying, emulsifying and suspension-forming compounds. The selected conditioning substance or substances should have an electronic configuration (sp- or d-configuration) of a kind which enables its preferred adsorption to the active metal surface, thus blocking undesired surface reactions. More particularly good results may be obtained with sulphur and/or nitrogen functioning of the iron surface by specific adsorption. In fact it has been found that it is possible by electrolytic cleaning with suitable baths to clean the strip of organic pollutants prior to annealing it. It is of importance that the selected substance does not contain any carbon atoms in its molecule at all, or at least so few carbon atoms that upon decomposition of this substance in the annealing heat hardly any gaseous CO is liberated.

It has been found that suitable additions to the conditioning bath may be selected from substances or combinations of substances from the group containing urea, thiosemicarbazide, ammonium thiosulphate, borax and thiourea.

It should be remarked that the new method eliminates a disadvantage of the method according to U.S. Pat. No. 3,632,487 because the formation of gaseous CO is seriously restricted or is even completely prevented. As the annealing operation is performed on a tightly wound coil, it is clear that CO gas which comes free from the reaction with organic pollutants cannot easily escape, which in the known method again gives rise to the formation of surface graphite through the unstable iron carbide phase. This disadvantage is avoided by the method according to the invention, as now steps are taken to eliminate the organic pollutants of the surface intensively before annealing.

It is known per se to clean a steel strip in an electrolytic bath. Because of the high requirements which are set for this cleaning, according to the invention it is preferred to add to the electrolysis bath sodium orthosilicate having a rtio of $SiO_2/Na_2O$ of between 0.4 and 0.6 and in which the chloride concentration remains lower than Ccl=50 ppm. A similar bath composition may also be used for the previous dip bath. A further guarantee of a clean strip may be achieved if in the electrolysis bath the strip is alternately kept cathodically and anodically charged in relation to electrodes in the bath, and in which the strip leaves the bath with an anodic charge.

Finally the invention also relates to th metal coated steel strip produced according to any of the described methods. It has been found that this material may be almost completely free from surface graphite, and also has an appearance which compares positively with tinned sheets treated in another way, even if such other material satisfies the standards of approval for absence of surface graphite.

The invention is now described with some examples. For comparison Examples 1 and 3 describe a known and usual method for the production of electrolytic tinned steel sheet material.

EXAMPLE 1

A low-C steel of a chemical composition and a quality suitable for production of usual trade qualities of cold-rolled electrolytic tinned steel sheets was produced by the LD steel-refining process.

The steel was cast in ingots in a usual manner, and after removal of the moulds and re-heating in pit furnaces in a usual manner, was rolled into slabs. After reheating in a pusher type furnace and after descaling of oxides a customary hot-rolling operation was performed and the hot-rolled strips obtained were coiled under suitable conditions. The hot-rolled coils thereupon were continuously pickled in a manner known per se and subsequently rinsed with cold and hot water, dried with hot air and oiled. These coils were cold rolled while being cooled by a lubricant (cold rolling reduction about 90%) and coiled.

From the cold rolled material obtained in this way, there were taken sample plates which on laboratory scale were electrolytically degreased (degreasing time 5 seconds at a current density of 8 $A/dm^2$ in a silicate-containing cleaning bath). After degreasing they were rinsed for 5 seconds in demineralised water at 80° C. Upon drying in cold air the samples were tightly packed and annealed for 7 hours at 650° C. in an argon atmosphere. The estimation of the surface for graphitisation intensity was performed by means of a light-microscope with an enlargement of 1000×. For each sample the number out of 100 randomly selected measuring places which showed graphite upon the focussing of the ocular-cross was determined. The measurements were carried out both near the side and in the middle of the samples and the observations were averaged. In this way the graphitisation intensity was expressed as a degree of coverage of the surface. On the surface treated as above described a degree of coverage of 40% was found. With such a degree of coverage a faultless electrolytic coating of a strip can be assumed to be impossible. To prepare the strip for electrolytic plating, it is skin-passed after annealing.

EXAMPLE 2

The method according to Example 1 was repeated several times, but in such a way that when rinsing, after electrolytic degreasing, there was added to the rinsing fluid respectively in each test 500 mg/l of one out of the following group of compounds:

urea
thiourea
thiosemicarbazide
ammonium thiosulphate
borax

The determination of the graphitisation intensity as described in Example 1 showed, in the order of the above mentioned compounds, a degree of coverage of 8; 7; 9; 10 and 11% respectively. Even with a degree of coverage of 11% it is evident that the surface-fault which is characteristic for the apperance of a graphitisation, no longer noticeably occurs upon metal coating.

EXAMPLE 3

Thereupon 350 cold-rolled coils were produced in continuous production according to the method described in Example 1.

These 350 cold rolled strips thereupon were uncoiled and cleaned by first passing them through a dip bath, then brushing them and thereupon passing them through an electrolytic bath in which saponifying, emulsifying and suspension forming compounds had been added to the bath liquids. After passage through the electrolytic bath, the strips were brushed again. The strips which had been intensively cleaned of adhering pollutant were thereupon passed through a second rinsing bath, dried, tightly coiled and annealed for recrystallisation under usual conditions. After annealing 15% of the coils showed surface graphitisation. The strips thereupon were skin-passed and metal coated by electrolysis under standard conditions. After coating 3% of the coils had to be downgraded because of the surface fault which is characteristic of graphitisation.

EXAMPLE 4

The test according to Example 3 was repeated, but with the difference that the said second rinsing bath through which the electrolitically cleaned strips were passed contained 500 mg/l of thiourea.

After recrystallisation by annealing 3% out of the 350 coils showed a slight surface graphitisation. After cold skin-passing and electrolytic coating under standard conditions none of the coils showed the surface fault which is characteristic for graphitisation, which reduced the down-grading to zero.

Alternatively in the performance of this example, the conditioning bath containing 500 mg/l of thiourea may be separate from and subsequent to the said second rinsing bath.

I claim:

1. In a method for the prevention of the formation of surface graphite on a steel strip from which the graphite originates out of the steel itself and upon which a metal coating layer is applied which includes the steps of (a) cold rolling a hot-rolled steel strip, (b) cleaning the cold rolled strip by means of an electrolysis bath to remove any carbonaceous material attached thereto, (c) rinsing the cleaned strip, (d) tightly coiling or packing the rinsed strip, annealing it and skin-passing it, and (e) electrolytically applying the said metal coating layer, the improvement which comprises in said rinsing step (c) or subsequently thereto, passing said strip through a bath which contains, in a suitable amount, a conditioning substance selected from the group consisting of urea, thiosemicarbazide, and a mixture of such substances which is preferentially adsorbed on the surface of the strip and which in the annealing hinders or prevents the formation of surface graphite by the carbon within the steel.

2. The method according to claim 1 wherein, prior to the cold-rolling step (a), the strip is pickled and rinsed.

3. The method according to claim 1 wherein the said cleaning step (b) comprises dipping the strip in a bath, brushing it, passing it through the said electrolysis bath and brushing it again.

4. The method according to claim 1 wherein the rinsing of step (c) is performed by a bath which contains said conditioning substance or mixture thereof.

5. The method to claim 1 wherein the said conditioning substance or mixture thereof are present in a bath through which the strip is passed subsequently to the rinsing step (c).

6. The method according to claim 1 wherein the concentration of said conditioning substance or mixture of such substances in the bath containing it is between 10 and 5000 ppm.

7. The method according to claim 1 wherein the said conditioning substance or each such substance has an electronic configuration (sp- or d-configuration) such that it is preferentially adsorbed onto the strip surface.

8. The method according to claim 1 wherein at least the electrolysis cleaning bath contains sodium orthosilicate with a $SiO_2/NaO_2$ ratio of between 0.4 and 0.6 and has a chloride concentration maintained at $Ccl^- < 50$ ppm.

9. The method according to claim 1 wherein in the electrolysis cleaning bath the strip is alternately charged cathodically and anodically in relation to electrodes placed in the bath, and the strip leaves the electrolysis bath with an anodic charge.

* * * * *